US010677256B1

(12) United States Patent
Govaert

(10) Patent No.: US 10,677,256 B1
(45) Date of Patent: Jun. 9, 2020

(54) CONNECTING ASSEMBLY FOR FLUID DISPENSING PUMP

(71) Applicant: Dart Industries Inc., Orlando, FL (US)

(72) Inventor: Arthur A. Govaert, Smetlede (BE)

(73) Assignee: Dart Industries Inc., Orlando, FL (US)

( * ) Notice: Subject to any disclaimer, the term of this patent is extended or adjusted under 35 U.S.C. 154(b) by 0 days.

(21) Appl. No.: 16/534,043

(22) Filed: Aug. 7, 2019

(51) Int. Cl.
*F04D 29/12* (2006.01)

(52) U.S. Cl.
CPC ..... *F04D 29/126* (2013.01)

(58) Field of Classification Search
CPC ..... F04D 29/126
See application file for complete search history.

(56) References Cited

U.S. PATENT DOCUMENTS 1,929,564 A * 10/1933 Mair ..... B05B 11/0064 222/38
3,245,569 A 4/1966 Essich
4,732,549 A * 3/1988 von Schuckmann ..... B05B 11/3059 222/153.13
4,739,904 A * 4/1988 Spencer ..... B05B 11/3015 222/109
4,770,323 A * 9/1988 Debard ..... B05B 11/0037 222/82
5,109,997 A 5/1992 Phillips
5,624,059 A * 4/1997 Lo ..... B05B 11/0027 222/309
5,740,949 A 4/1998 Park
6,164,498 A * 12/2000 Faughey ..... B05B 11/3008 222/153.13
7,232,046 B1 * 6/2007 Stassi ..... B67D 1/0425 141/64
9,033,682 B2 5/2015 Thalmann
2003/0141272 A1 7/2003 De La Cruz
2004/0169001 A1 9/2004 Leendersten et al.
2009/0294487 A1 * 12/2009 Finlay ..... B67D 1/0456 222/506

FOREIGN PATENT DOCUMENTS

CN 207759352 8/1918
EP 0087562 B1 4/1986
EP 2692657 A1 2/2014
EP 2692659 A1 2/2014

* cited by examiner

*Primary Examiner* — David P Angwin
*Assistant Examiner* — Bob Zadeh
(74) *Attorney, Agent, or Firm* — Taylor J. Ross

(57) ABSTRACT

A connecting assembly for a fluid dispensing pump to dispense fluid from a container is disclosed. The connecting assembly includes a first connector adapted to rotatably couple with the housing and a second connector adapted to threadably engage with the first connector. The first connector and the second connector together define a receiving portion to accommodate the neck of the container. The connecting assembly further includes multiple sliders movably disposed within the receiving portion. In such arrangement, movement of the first connector relative to the second connector along a longitudinal axis of the connecting assembly allows movement of the sliders in a radial direction of the connecting assembly. In addition, the connecting assembly includes at least one seal disposed on the sliders to engage with an inner surface of the neck of the container.

18 Claims, 8 Drawing Sheets

CONNECTING ASSEMBLY FOR FLUID DISPENSING PUMP

CROSS REFERENCE TO RELATED APPLICATIONS

This application is related to co-pending Ser. No. 29/700,953, filed Aug. 7, 2019, which is incorporated by reference herein.

STATEMENT REGARDING FEDERALLY SPONSORED RESEARCH

Not applicable.

TECHNICAL FIELD

The present disclosure relates, in general, to connecting assembly and, more specifically relates to connecting assembly for fluid dispensing pump provided in a container to dispense fluid.

BACKGROUND

It is often desirable to dispense fluid, such as water, by desired amounts from container or barrel. Dispensers operating according to pump principle cater to such requirement of dispensing the desired amounts of the fluid. Generally, such dispensers include components which are either manually actuated or electronically actuated to dispense the fluid. Besides the functionality of dispensing the desired amounts of fluid, it is necessary to consider user convenience with respect to mounting such dispensers on the container. Additionally, it is desired that portions of the dispenser engaging with the container provide rigid engagement against the container surface and aid easy engagement and disengagement to and from the container.

U.S. Pat. No. 9,033,682 discloses a hand pump for pumping fluid of a motor vehicle. The hand hand pump includes a housing, an actuating body movably and axially mounted in the housing, and a membrane with a flexible ring section surrounding a stroke axis. During stroke movement, the actuating body is pressed with the membrane against the force of an elastic element from a resting position into the housing and into an actuating position, and returned to the resting position by the elastic element. This allows a volume of a pump chamber to be modified.

U.S Pat. Publication No. 2004/0169001 discloses a bottle closure including a shell having an open first end, a closed second end, an inner wall and an outer wall, the combination forming conical space. The bottle closure also includes a tapered core having a first end, a second end and conical surface positioned between the first end and second end. The tapered core is larger than the shell conical space.

SUMMARY

According to one aspect of the present disclosure, a connecting assembly for a fluid dispensing pump to dispense fluid from a container is disclosed. The fluid dispensing pump includes a housing and a fluid chamber defined within the housing. The fluid chamber is in fluid communication with the container and a spout extending from the fluid chamber. The fluid dispensing pump further includes means for drawing fluid into the fluid chamber from the container and thereafter dispensing the fluid through the spout. The fluid dispensing pump also includes the connecting assembly adapted to couple the housing with a neck of the container.

Further, the connecting assembly includes a first connector adapted to rotatably couple with the housing and a second connector adapted to threadably engage with the first connector. The first connector and the second connector together define a receiving portion to accommodate the neck of the container. The connecting assembly further includes multiple sliders movably disposed within the receiving portion. In such arrangement, movement of the first connector relative to the second connector, along a longitudinal axis of the connecting assembly, allows movement of the sliders in a radial direction of the connecting assembly. In addition, the connecting assembly includes at least one seal disposed on the sliders to engage with an inner surface of the neck of the container.

Preferably, the first connector includes a cylindrical portion and a tapering portion extending from the cylindrical portion. The cylindrical portion includes threads, defined at an outer surface thereof, adapted to rotatably engage with the housing. Conveniently, the cylindrical portion and the tapering portion allow flow of fluid from the container to the housing, particularly to the fluid chamber defined within the housing. The first connector also includes one or more hand grips extending radially outward from the outer surface of the cylindrical portion.

Preferably, the second connector includes a top portion and a bottom portion extending from the top portion. The top portion includes threads at an inner surface thereof and is adapted to threadably engage with the cylindrical portion of the first connector. Conveniently, the bottom portion and the tapering portion of the first connector together define the receiving portion. The second connector also includes a flange extending radially inward from the inner surface of the top portion. The flange includes multiple cutouts extending in the radial direction of the connecting assembly.

Further, each of the multiple sliders includes an arcuate wall portion, an arcuate ridge portion having a diameter greater than a diameter of the arcuate wall portion, and a sliding portion connecting the arcuate wall portion and the arcuate ridge portion. The sliding portion is adapted to move along the cutout defined in the flange.

Advantageously, the arcuate wall portion includes a spherical projection extending from an inner surface thereof. The spherical projection is adapted to abut the tapering portion of the first connector. The arcuate wall portion also includes at least one groove at an outer surface thereof to receive the at least one seal. Preferably, the at least one seal is an O-ring and is adapted to bias the sliders towards the tapering portion of the first connector.

According to another aspect of the present disclosure, a pump for dispensing fluid from a container having a neck is provided. The pump includes a housing defining a fluid chamber, a reciprocating member movably disposed within the fluid chamber to dispense the fluid, and a connecting assembly adapted to couple the housing with the neck of the container. In an embodiment, the connecting assembly includes a first connector adapted to rotatably couple with the housing and a second connector adapted to threadably engage with the first connector. The first connector and the second connector together define a receiving portion to accommodate the neck of the container. The connecting assembly further includes a sliding device movably disposed within the receiving portion. In such arrangement, movement of the first connector relative to the second connector, along a longitudinal axis of the pump, engages the sliding device with an inner surface of the neck of the container.

Preferably, the first connector includes a cylindrical portion and a tapering portion extending from the cylindrical portion. The cylindrical portion includes threads defined at an outer surface thereof and a recess defined at an inner surface thereof. The recess is adapted to rotatably engage with a leg extending from a bottom wall of the housing. The first connector also includes a tapering portion extending from the cylindrical portion. The cylindrical portion and the tapering portion allow flow of fluid from the container to the fluid chamber. The first connector further includes at least one hand grip extending radially outward from the outer surface of the cylindrical portion.

Preferably, the second connector includes a top portion and a bottom portion extending from the top portion. The top portion is provided with threads at an inner surface thereof and is adapted to threadably engage with the cylindrical portion of the first connector. The bottom portion and the tapering portion of the first connector together define the receiving portion. The second connector also includes a flange extending radially inward from the inner surface of the top portion. Multiple cutouts are formed in the flange and extend in a radial direction of the pump. Further, the flange includes a pair of walls extending from either side of each cutout, and a stopper defined at an inner edge thereof and between two adjacent cutouts.

The sliding device includes multiple sliders disposed between the tapering portion of the first connector and the bottom portion of the second connector. Each slider is adapted to movably couple with the flange of the second connector, particularly with the cutout defined in the flange.

Further, each slider includes an arcuate wall portion, an arcuate ridge portion having a diameter greater than a diameter of the arcuate wall portion, and a sliding portion connecting the arcuate wall portion and the arcuate ridge portion. The sliding portion is adapted to move along the cutout of the flange. Particularly, the sliding portion includes at least one raised portion having a width less than a width defined by the pair of walls in the flange, so that the sliding portion can slide along the cutout. The raised portion and the pair of walls together guide movement of the slider along the cutout.

Advantageously, the arcuate ridge portion includes a step portion. The step portion and the stopper provided in the flange together restrict radial movement of the slider within a distance defined by a width of the flange, thereby retaining the slider coupled to the flange.

Advantageously, the arcuate wall portion includes a spherical projection extending from an inner surface thereof and at least one groove defined at an outer surface thereof. The spherical projection is adapted to abut the tapering portion of the first connector, such that the sliding device moves in the radial direction of the connecting assembly based on movement of the first connector with respect to the second connector.

The connecting assembly further includes at least one seal disposed in the at least one groove of the arcuate wall portion. The at least one seal is an O-ring adapted to bias the sliders towards the tapering portion of the first connector. The movement of the sliders in the radial direction of the connecting assembly causes the at least one seal to engage with the inner surface of the neck of the container, thereby engaging the pump with the container.

These and other aspects and features of non-limiting embodiments of the present disclosure will now become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
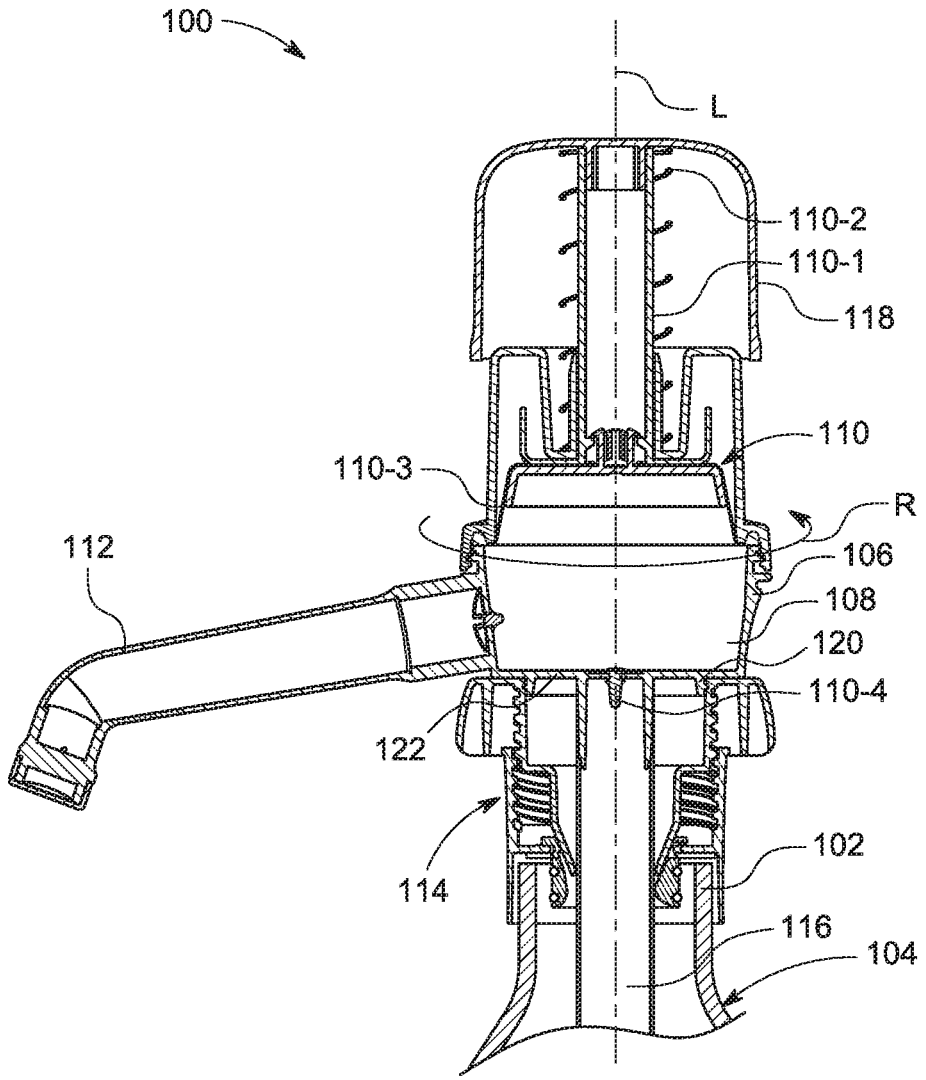
FIG. 1 is a cross-sectional view of a fluid dispensing pump mounted to a neck of a container, according to an embodiment of the present disclosure.

Referring to FIG. 1, a cross-sectional view of a fluid dispensing pump 100 mounted to a neck 102 of a container 104 is illustrated according to an embodiment of the present disclosure. The fluid dispensing pump 100 is generally and alternatively referred to as the pump 100 henceforth in the present disclosure. The container 104 is generally considered to have a cylindrical configuration, with a closed bottom end, an open top end, and the neck 102. The pump 100 includes a housing 106, a fluid chamber 108 defined within the housing 106, and means 110 for drawing fluid into the fluid chamber 108 from the container 104. The fluid chamber 108 is in fluid communication with the container 104 and a spout 112. The pump 100 also includes a connecting assembly 114 adapted to couple the housing 106 with the neck 102 of the container 104. Further, a pipe 116 extending from the housing 106 aids in fluid communication between the fluid chamber 108 and the container 104. As will be understood by one skilled in the art, to-and-fro reciprocating movement of a cap 118 that is coupled to the housing 106, along a longitudinal axis 'L' of the pump 100, causes the means 110 to draw the fluid into the fluid chamber 108 from the container 104 through the pipe 116 and thereafter dispense the fluid through the spout 112. As such, it will be understood that the means 110 herein would include a connecting rod 110-1 extending from the cap 118, a resilient member 110-2, such as a spring, disposed around the connecting rod 110-1, a silicone membrane 110-3 connected between the housing 106 and the connecting rod 110-1, a valve seal 110-4 provided in a bottom wall 122 of the housing 106, and the pipe 116. In the illustrated embodiment, the silicone membrane 110-3 functions as a reciprocating member, disposed in the fluid chamber 108, to dispense the fluid through the spout 112. Although the pump 100 herein is illustrated as a mechanical manual pump, other types of pumps known in the art, such as an electric pump, are envisaged by the present disclosure. In such alternative pumps, the means 110 may include electric actuators or any other arrangement known in the art.

Figure 2:
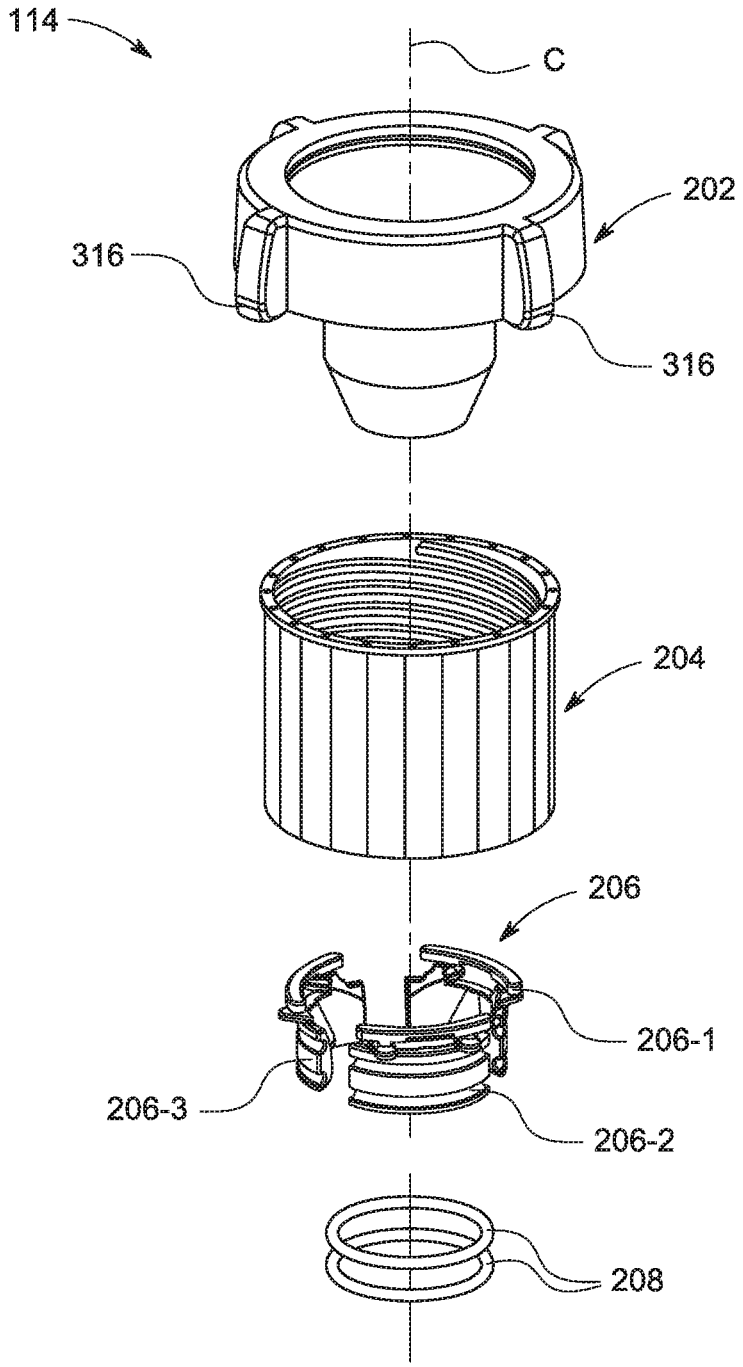
FIG. 2 is an exploded view of a connecting assembly of the fluid dispensing pump of FIG. 1, according to an embodiment of the present disclosure.

Further, referring to FIG. 2, an exploded view of the connecting assembly 114 of FIG. 1 is illustrated. The connecting assembly 114 includes a first connector 202 adapted to rotatably couple with the housing 106, a second connector 204 adapted to couple with the first connector 202, a sliding device 206 that is disposed on the first connector 202 by the aid of one or more seals 208. The sliding device 206 includes multiple sliders 206-1, 206-2, 206-3. Although three sliders are illustrated, it will be understood that any number of sliders may be implemented.

Figure 3:
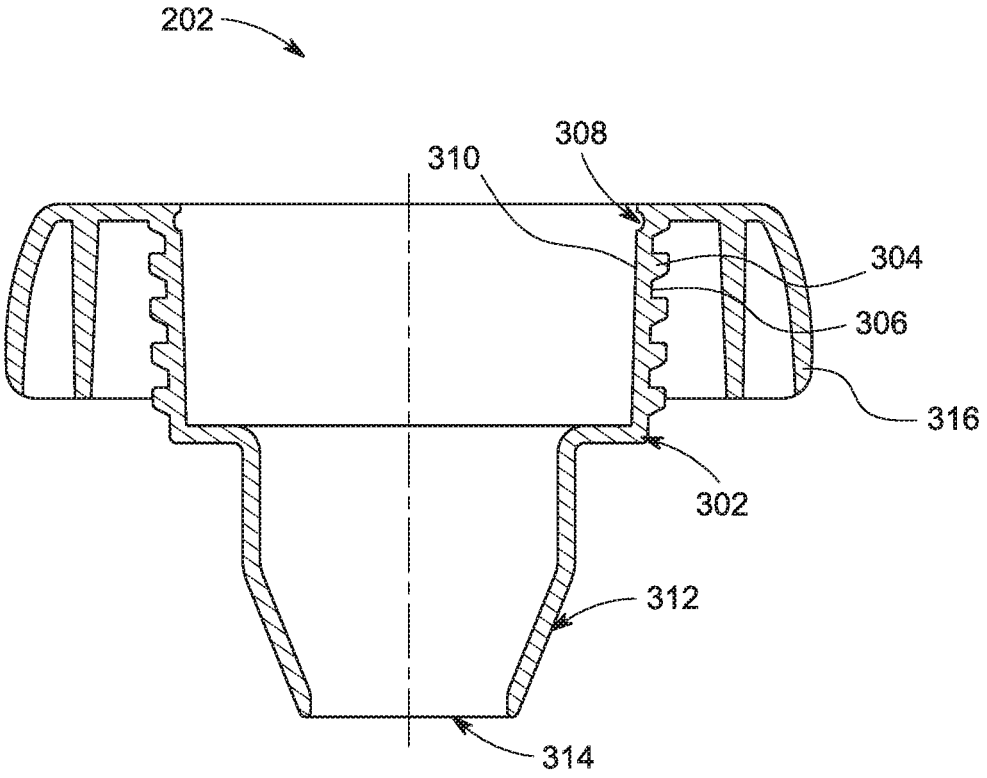
FIG. 3 is a cross-sectional view of a first connector of the connecting assembly, according to an embodiment of the present disclosure.

FIG. 3 illustrates a cross-sectional view of the first connector 202, according to an embodiment of the present disclosure. For the purpose of clarity, FIG. 3 is described in conjunction with FIG. 1. The first connector 202 includes a cylindrical portion 302 having threads 304 formed at an outer surface 306 thereof and a recess 308 formed at an inner surface 310 thereof. The term 'recess' used herein may be understood as a groove that extends circumferentially along the inner surface 310 of the cylindrical portion 302. The recess 308 is adapted to engage with a leg 120 (see FIG. 1) extending from the bottom wall 122 of the housing 106. Engagement between the recess 308 of the first connector 202 and the leg 120 of the housing 106 may, for example, be a snap connection. With such construction, once the housing 106 is coupled with the first connector 202, the housing 106 may be rotated (indicated by arc a' in FIG. 1) with respect to the longitudinal axis 'L' of the pump 100 when the first connector 202 is stationary. Rotation of the housing 106 may be restricted based on a length of the recess 308. For instance, the recess 308 extending completely along the circumference of the inner surface 310 would allow a complete rotation of the housing 106 about the longitudinal axis 'L' of the pump 100, while a partial recess length would allow only partial rotation of the housing 106. In some embodiments, engagement between the housing 106 and the first connector 202 may be push-fit of the type known in the art. Nevertheless, such embodiments may still include structures similar to the leg 120 and the recess 308 described herein to allow the housing 106 to be engaged with the first connector 202. Further, in some embodiments, arrangements (not shown) to dislodge the housing 106 from the first connector 202 may be provided.

The first connector 202 further includes a tapering portion 312 extending from the cylindrical portion 302. The tapering portion 312 is embodied as a frustoconical structure. As illustrated so far in FIG. 1 to FIG. 3, the first connector 202 is embodied as a hollow structure with two open ends, where one open end 314 is defined in the tapering portion 312. The open end 314 is adapted to receive the pipe 116. As illustrated in FIG. 1, periphery of the open end 314 is dimensioned and adapted to abut the pipe 116. As such, the cylindrical portion 302 and the tapering portion 312 allow flow of fluid from the container 104 to the housing 106, particularly to the fluid chamber 108 in the housing 106.

The first connector 202 also includes one or more hand grips 316 to allow a user to grasp the first connector 202 while installing the pump 100 to the container 104. The hand grips 316 (also clearly depicted in FIG. 2) extend radially outward from the cylindrical portion 302. In other embodiments, other hand grips known in the art may be implemented.

Figure 4A:
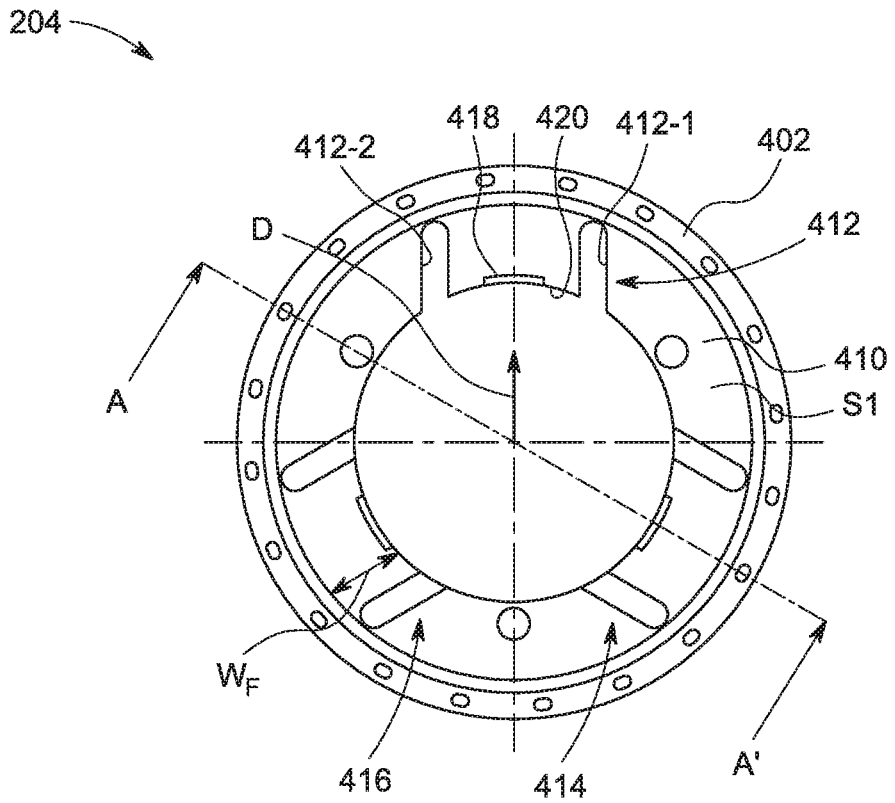
FIG. 4A is a top view of a second connector of the connecting assembly, according to an embodiment of the present disclosure.
Figure 4B:
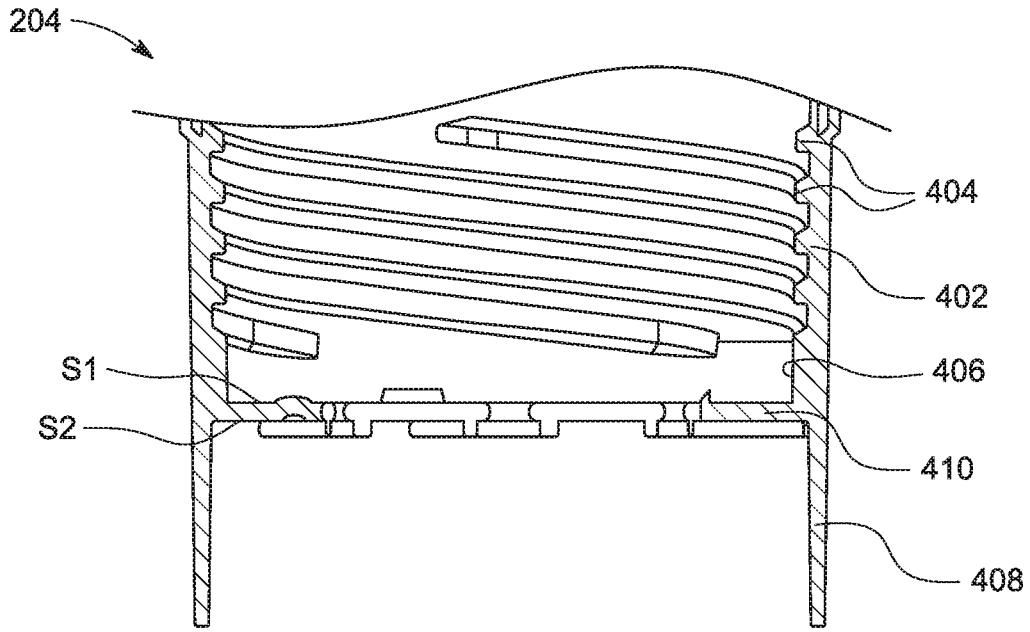
FIG. 4B is a sectional view of the second connector taken along section A-A' in FIG. 4A, according to an embodiment of the present disclosure.

Referring to FIG. 4A, a top view of the second connector 204 is illustrated. Also referring to FIG. 4B, a sectional view of the second connector 204 taken along section A-A' in FIG. 4A is illustrated. For the purpose of clarity, FIG. 4A and FIG. 4B are described in conjunction to one another. As illustrated in FIG. 4B, the second connector 204 includes a top portion 402 defining threads 404 at an inner surface 406 thereof. The threads 404 of the second connector 204 are dimensioned to engage with the threads 304 of the first connector 202, which will be described later. Extending from the top portion 402 is a bottom portion 408 of the second connector 204. Further, the second connector 204 includes a flange 410 extending radially inward from the inner surface 406 of the top portion 402. The flange 410 is embodied as a disc-like structure that separates the top portion 402 from the bottom portion 408.

In an embodiment, multiple cutouts are formed in the flange 410 and extend in the radial direction 'ID' of the connecting assembly 114, more particularly in the radial direction 'ID' of the second connector 204. The cutouts are formed in pairs, and each pair of cutouts is located about 120 degrees apart from an adjacent pair of cutouts. As illustrated in FIG. 4A, a first pair of cutouts 412 are spaced about 120 degrees apart from a second pair of cutouts 414 on one side and a third pair of cutouts 416 on other side. The flange 410 further includes stoppers defined between two adjacent cutouts of one pair of cutouts. For instance, a stopper 418 is defined at an inner edge 420 of the flange 410 and between a first cutout 412-1 and a second cutout 412-2 of the first pair of cutouts 412. The stopper 418 is illustrated as a small extension from a top surface 'S1' of the flange 410.

Figure 4C:
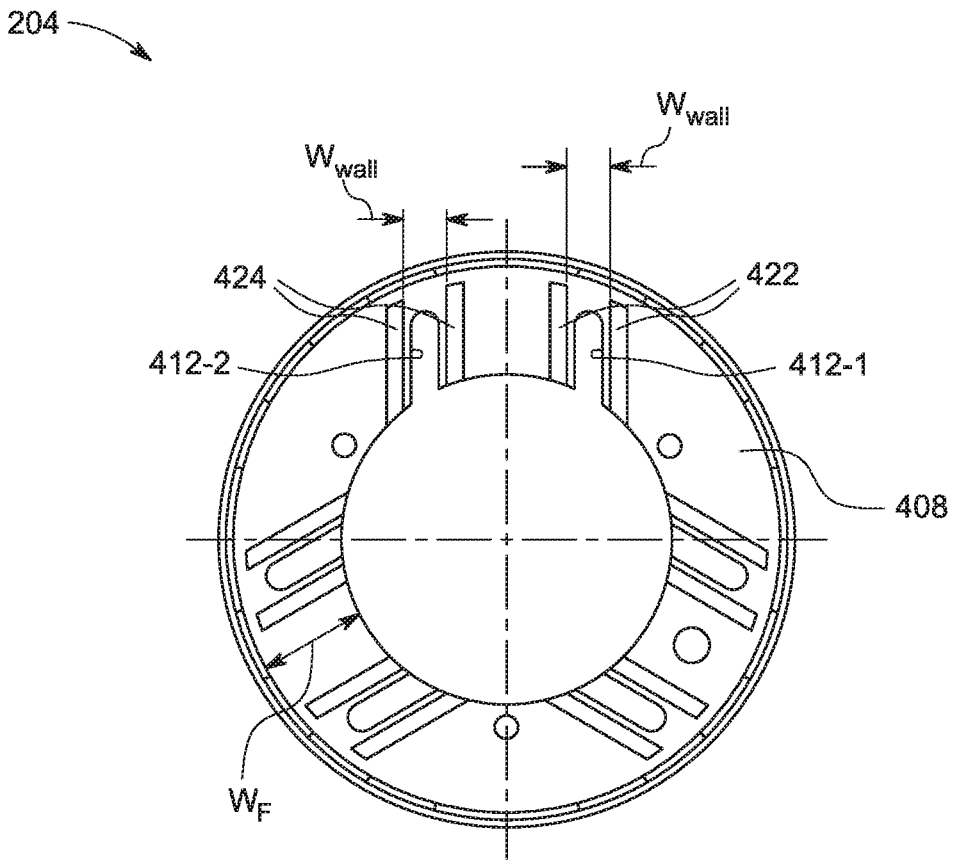
FIG. 4C is a bottom view of the second connector, according to an embodiment of the present disclosure.

Referring to FIG. 4C, a bottom view of the second connector 204 is illustrated. The flange 410 further includes a pair of walls extending from a bottom surface 'S2' of the flange 410 on either side of each cutout. For the purpose of clarity and conciseness, one pair of cutouts and corresponding pairs of walls are referenced herein below. As illustrated in FIG. 4C, a first pair of walls 422 extend on either side of the first cutout 412-1 and a second pair of walls 424 extend on either side of the second cutout 412-2.

Figure 5A:
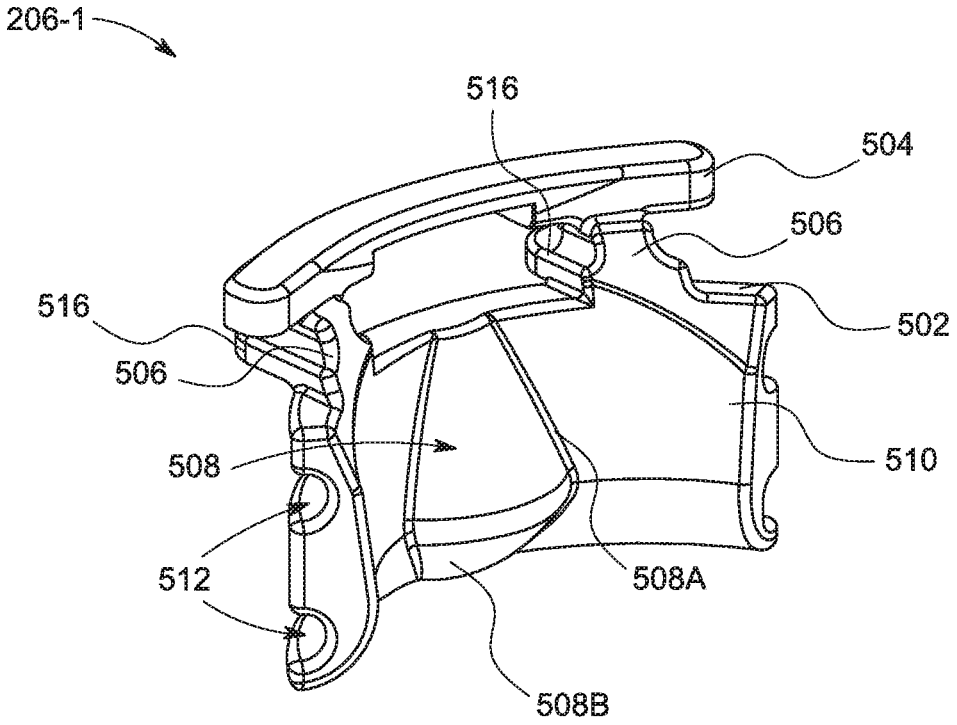
FIG. 5A is a perspective view of a slider of the connecting assembly, according to an embodiment of the present disclosure.
Figure 5B:
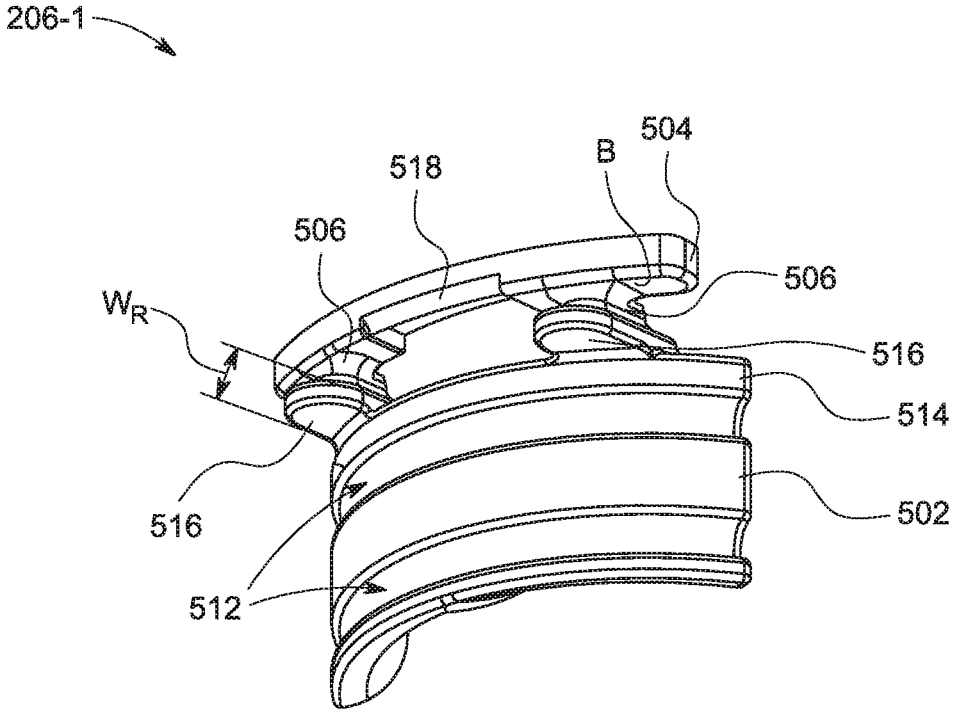
FIG. 5B is another perspective view of the slider, according to an embodiment of the present disclosure.

FIG. 5A and FIG. 5B illustrates perspective views of the slider 206-1 of the sliding device 206. The slider 206-1 includes an arcuate wall portion 502, an arcuate ridge portion 504 having a diameter greater than a diameter of the arcuate wall portion 502. Sliding portions 506 connects the arcuate wall portion 502 to the arcuate ridge portion 504. Further, the arcuate wall portion 502 includes a spherical projection 508 extending from an inner surface 510 thereof and one or more grooves 512 formed at an outer surface 514 thereof and adapted to receive the one or more seals 208. In an embodiment, the seals 208 may be O-ring.

Although the projection from the inner surface 510 of the arcuate wall portion 502 is referred to as the spherical projection 508 that includes a frustoconical surface 508A and an arcuate surface 508B, it is appreciated that other shapes or combination of shapes are envisaged by the present disclosure to constitute the projection. Further, in an embodiment, the sliding portions 506 includes raised portions 516. Particularly, each sliding portion 506 includes one raised portion 516. As illustrated in FIG. 5B, the raised portions 516 extends in a radial outward direction with respect to the outer surface 514 of the arcuate wall portion 502. In another embodiment, the raised portions 516 may extend from the outer surface 514 of the arcuate wall portion 502, instead of the sliding portion 506, without interfering with the grooves 512. In yet another embodiment, a single sliding portion 506 may connect the arcuate wall portion 502 to the arcuate ridge portion 504. Furthermore, the arcuate ridge portion 504 includes a step portion 518 located at a bottom surface 'B' thereof.

Figure 6A:
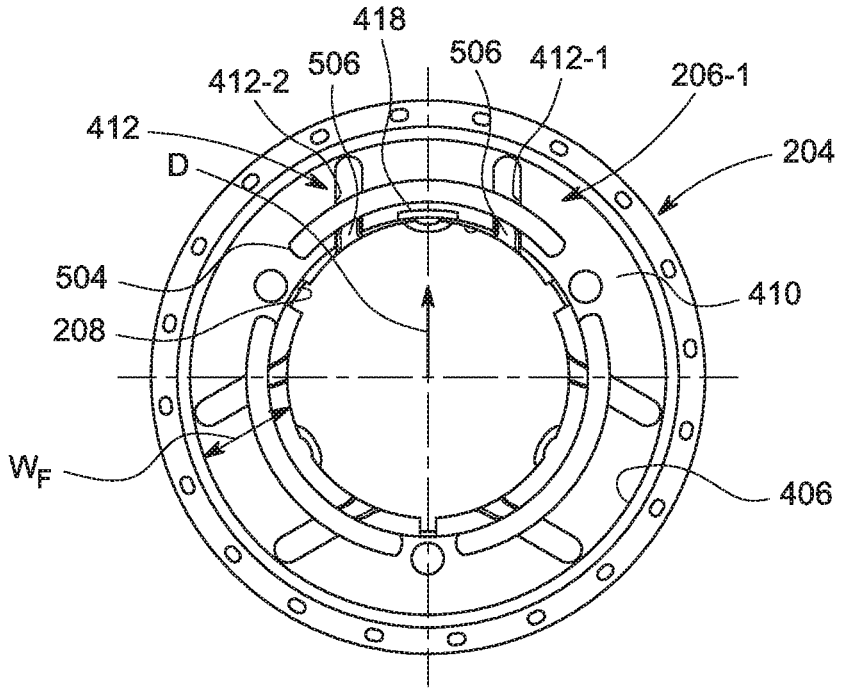
FIG. 6A is a top plan view showing engagement between sliders and a flange of the second connector, according to an embodiment of the present disclosure.

Referring to FIG. 6A, a top plan view of the second connector 204 is illustrated to depict the engagement between the sliding device 206 and the flange 410. As described earlier with reference to FIG. 2, the sliding device 206 includes three sliders 206-1, 206-2, and 206-3. For the purpose of clarity and conciseness, the engagement is described with respect to one slider 206-1 and the first pair of cutouts 412. The slider 206-1 is positioned in a manner such that the sliding portions 506 are aligned with the first and second cutouts 412-1 and 412-2. The arcuate ridge portion 504 is positioned on the flange 410 such that the step portion 518 (see FIG. 5B) lies radially behind the stopper 418. As seen in FIG. 6A, the slider 206-1 is shown displaced radially along the first pair of cutouts 412. The step portion 518 and the stopper 418 described herein together restricts radial movement of the slider 206-1 within a distance defined by a width '$W_F$' (also indicated in FIG. 4A and FIG. 4C) of the flange 410. In other words, the inner surface 406 of the second connector 204 and the stopper 418 define a maximum and minimum limits, respectively, for radial movement of the slider 206-1 along the cutouts 412. The other two sliders are engaged with the flange 410 in a similar manner. Further, the seals 208 are engaged with the grooves 512 of all sliders, where tension in the seals 208 cause the sliders to lie in a circular configuration as depicted in FIG. 6A.

Figure 6B:
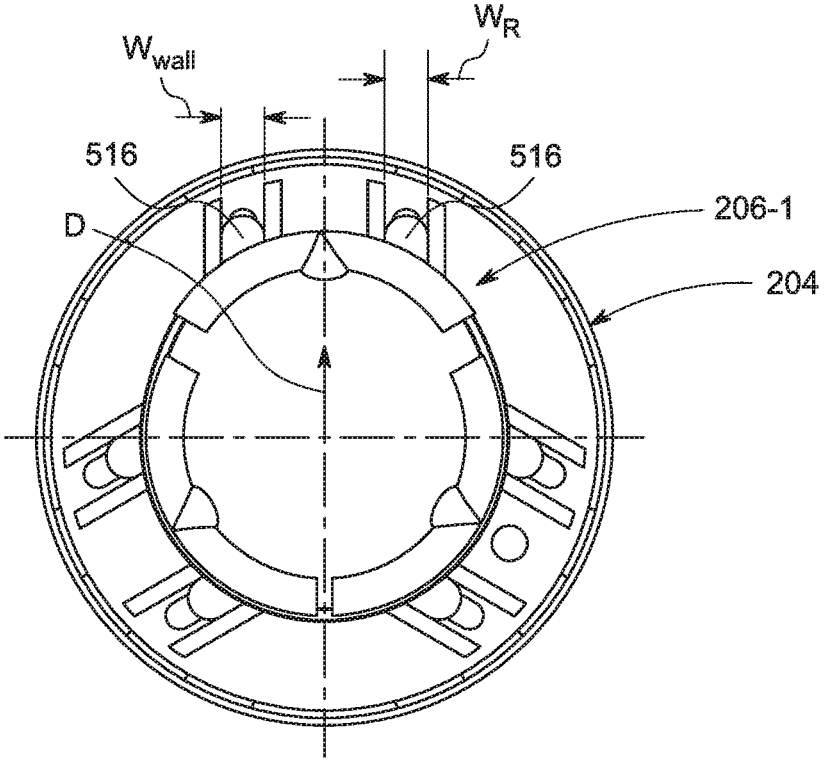
FIG. 6B is a bottom plan view showing engagement between the sliders and the flange, according to an embodiment of the present disclosure.

A bottom plan view of the second connector 204 is illustrated in FIG. 6B to depict the engagement between the sliding device 206 and the flange 410. Specifically, FIG. 6B illustrates a bottom view of the engagement illustrated in FIG. 6A. In the illustrated embodiment, the raised portions 516 of the first slider 206-1 are shown slid in the radial direction 'D'. In order to allow sliding of the sliding portion 506 along the cutouts 412, width '$W_R$' (clearly shown in FIG. 5B) of the raised portions 516 are dimensioned to be less than a width '$W_{Wall}$' (clearly depicted in FIG. 4C) defined by the first pair of walls 422 and the second pair of walls 424. In other words, the width of each raised portion 516 is dimensioned such that the raised portion 516 is received between the walls of respective pair of walls 422 and 424. As such, the walls guide the sliding movement of the raised portion 516 along the cutouts 412.

Figure 7A:
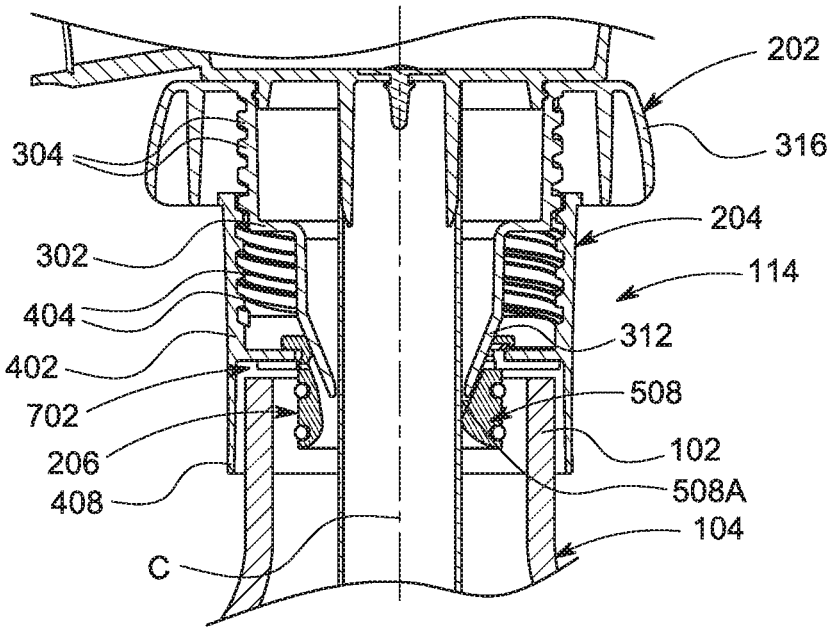
FIG. 7A is a cross-sectional view of the connecting assembly disengaged from the neck of the container, according to an embodiment of the present disclosure.

FIG. 7A illustrates a cross-sectional view of the connecting assembly 114 disengaged from the neck 102 of the container 104. The second connector 204 is adapted to threadably engage with the first connector 202. In particular, the threads 404 of the top portion 402 of the second connector 204 is adapted to engage with the threads 304 of the cylindrical portion 302 of the first connector 202. Further, the first connector 202 and the second connector 204 together define a receiving portion 702 to accommodate the neck 102 of the container 104. Specifically, the bottom portion 408 of the second connector 204 and the tapering portion 312 of the first connector 202 together define the receiving portion 702. As illustrated in FIG. 1 and FIG. 7A, when the first connector 202 is coupled with the second connector 204, the tapering portion 312 of the first connector 202 abuts the frustoconical surface 508A of the spherical projection 508. As such, the sliders of the sliding device 206 are disposed between the tapering portion 312 and the bottom portion 408 of the second connector 204. The seals 208 biases the sliders of the sliding device 206 towards the tapering portion 312.

Figure 7B:
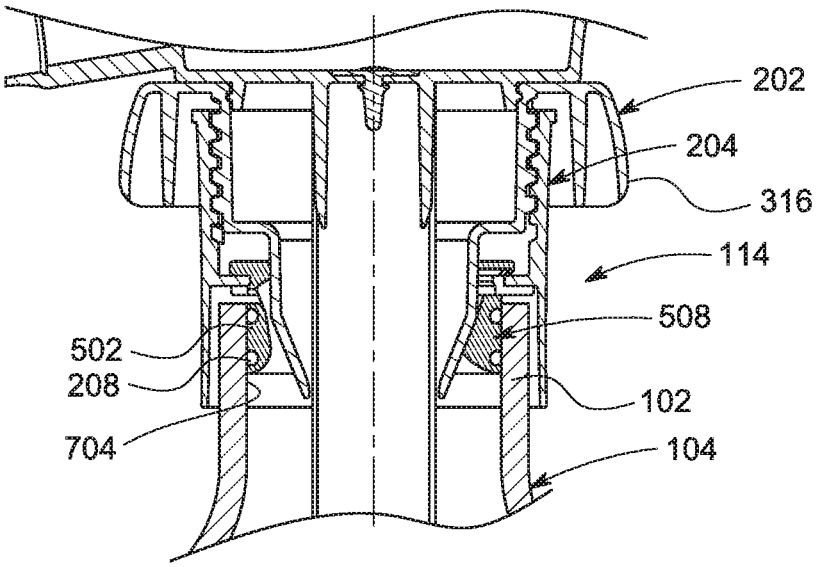
FIG. 7B is a cross-sectional view of the connecting assembly engaged with the neck of the container, according to an embodiment of the present disclosure.

FIG. 7B illustrates a cross-sectional view of the connecting assembly 114 engaged with the neck 102 of the container 104. The first connector 202 may be rotated about a longitudinal axis 'C' of the connecting assembly 114, or about the longitudinal axis of the pump 100. Engagement of the threads 304 and 404 results in linear movement of the first connector 202 along the longitudinal axis 'C' (shown in FIG. 2) of the connecting assembly 114. Here, it should be noted that the longitudinal axis 'C' of the connecting assembly 114 coincides with the longitudinal axis of the pump 100 when the connecting assembly 114 is coupled to the housing 106. During the linear movement of the first connector 202, the tapering portion 312 functions as a cam and the spherical projection 508 that abuts the tapering portions 312 functions as a cam follower. Accordingly, movement of the first connector 202 with respect to the second connector 204 allows movement of the sliders in the radial direction 'D' of the connecting assembly 114. In an engaged condition of the first connector 202 and the second connector 204, the threads 304 and 404 are visually obscured and hence ingress of dust into the connecting assembly 114 may be prevented.

The first connector 202 may be rotated with the aid of the hand grips 316 until the sliding device 206, particularly the arcuate wall portion 502 and the seals 208, engages with an inner surface 704 of the neck 102 of the container 104. Thus, the connecting assembly 114 of the present disclosure finds applicability for dispensing fluids from the container 104 and provides rigid connection at the neck 102 of the container 104. Since the thread engagement is reversible, the first connector 202 may be rotated in a reverse direction to disengage the connecting assembly 114 from the container 104. It is noted that the inner surface 704 of neck 102 will typically be circular/tubular, and of a diameter greater than that of the sliders at their radially inner position. As such, the engagement of seals 208 against the inner surface 704 may not be continuous about the circumference of inner surface 704, but rather may be at three discrete locations corresponding to the locations of the sliders. In such a situation the seals 208 will not create a fluid-tight seal within inner surface 704, but the pump 100 will nonetheless be fully secured to container 104.

It is to be understood that all matter herein set forth and shown in the accompanying drawings is to be interpreted as illustrative, and not in a limiting sense. It is contemplated that certain features and combinations described herein may be employed to arrive at various other embodiments. For instance, in one embodiment, the engagement between the first connector 202 and the second connector 204 may be achieved by a press-fit, which can still allow the radial movement of the sliding device 206. With such alternate means of engagement, the connectors 202 and 204 may need not have a circular cross-section. In another embodiment, the sliding device 206 may include a single raised portion 516 and accordingly the flange 410 may define a single cutout to movably receive the single raised portion 516. In yet another embodiment, the sliding device 206 may include more or fewer sliders instead of three sliders as illustrated in the present disclosure. As an example, if two sliders were used then each of the two sliders may include one raised portion 516 instead of two raised portions 516. Similarly, the features and/or embodiments described herein may be combined in any manner to result in additional embodiments and arrive at the utility established by the present disclosure, albeit with few variations to embodiments described herein. Such additional embodiments should be understood to fall within the scope of the present disclosure as determined based upon the claims and any equivalents thereof.

What is claimed is:

1. A connecting assembly for a fluid dispensing pump to dispense fluid from a container, the fluid dispensing pump comprising a housing, a fluid chamber within the housing in fluid communication with the container and a spout, means for drawing fluid from the container into the fluid chamber and thereafter dispensing the fluid from the spout, and the connecting assembly adapted to couple the housing with a neck of the container, the connecting assembly comprising:

a first connector adapted to rotatably couple with the housing;

a second connector adapted to threadably engage with the first connector, wherein the first connector and the second connector together define a receiving portion to accommodate the neck of the container;

a plurality of sliders movably disposed within the receiving portion, wherein movement of the first connector relative to the second connector along a longitudinal axis of the connecting assembly allows movement of the plurality of sliders in a radial direction of the connecting assembly; and at least one seal disposed on the plurality of sliders to engage with an inner surface of the neck of the container.

2. The connecting assembly according to claim 1, wherein the first connector comprises:

a cylindrical portion having threads defined at an outer surface thereof, and adapted to rotatably engage with the housing;

a tapering portion extending from the cylindrical portion, wherein the cylindrical portion and the tapering portion allow flow of fluid from the container to the housing; and at least one hand grip extending radially outward from the cylindrical portion.

3. The connecting assembly according to claim 2, wherein the second connector comprises:

a top portion defining threads at an inner surface thereof, wherein the top portion is adapted to threadably engage with the cylindrical portion of the first connector;

a bottom portion extending from the top portion, wherein the bottom portion and the tapering portion of the first connector together define the receiving portion; and a flange extending radially inward from the inner surface of the top portion, wherein the flange comprises a plurality of cutouts extending in the radial direction of the connecting assembly.

4. The connecting assembly according to claim 3, wherein each slider of the plurality of sliders comprises:

an arcuate wall portion;

an arcuate ridge portion having a diameter greater than a diameter of the arcuate wall portion; and a sliding portion connecting the arcuate wall portion and the arcuate ridge portion, wherein the sliding portion is adapted to move along the cutout.

5. The connecting assembly according to claim 4, wherein the arcuate wall portion comprises:

a spherical projection extending from an inner surface thereof, and adapted to abut with the tapering portion of the first connector; and at least one groove at an outer surface thereof to receive the at least one seal.

6. The connecting assembly according to claim 5, wherein the at least one seal is an O-ring adapted to bias the plurality of sliders towards the tapering portion of the first connector.

7. A pump for dispensing fluid from a container having a neck, the pump comprising:

a housing defining a fluid chamber;

a reciprocating member movably disposed within the fluid chamber to dispense the fluid; and a connecting assembly adapted to couple the housing with the neck of the container, the connecting assembly comprising:

a first connector adapted to rotatably couple with the housing;

a second connector adapted to threadably engage with the first connector, wherein the first connector and the second connector together define a receiving portion to accommodate the neck of the container; and a sliding device movably disposed within the receiving portion, wherein downward movement of the first connector relative to the second connector along a longitudinal axis of the pump engages the sliding device with an inner surface of the neck of the container.

8. The pump according to claim 7, wherein the first connector comprises:

a cylindrical portion having threads defined at an outer surface thereof and a recess defined at an inner surface thereof, wherein the recess is adapted to rotatably engage with a leg extending from a bottom wall of the housing; and a tapering portion extending from the cylindrical portion, wherein the cylindrical portion and the tapering portion allow flow of fluid from the container to the fluid chamber.

9. The pump according to claim 8, wherein the second connector comprises:

a top portion defining threads at an inner surface thereof, wherein the top portion is adapted to threadably engage with the cylindrical portion of the first connector;

a bottom portion extending from the top portion, wherein the bottom portion and the tapering portion of the first connector together define the receiving portion; and a flange extending radially inward from the inner surface of the top portion, wherein the flange comprises a plurality of cutouts extending in a radial direction of the pump.

10. The pump according to claim 9, wherein the sliding device comprises a plurality of sliders disposed between the tapering portion of the first connector and the bottom portion of the second connector, and wherein each of the plurality of sliders is adapted to movably couple with the flange of the second connector.

11. The pump according to claim 10, wherein each slider of the plurality of sliders comprises:

an arcuate wall portion;

an arcuate ridge portion having a diameter greater than a diameter of the arcuate wall portion; and a sliding portion connecting the arcuate wall portion and the arcuate ridge portion, wherein the sliding portion is adapted to move along the cutout of the flange.

12. The pump according to claim 11, wherein the flange comprises:

a pair of walls extending from either side of each cutout of the plurality of cutouts; and a stopper defined between two adjacent cutouts of the plurality of cutouts at an inner edge thereof.

13. The pump according to claim 12, wherein the sliding portion comprises a raised portion having a width less than a width defined by the pair of walls to guide movement of the slider along the cutout.

14. The pump according to claim 12, wherein the arcuate ridge portion comprises a step portion, wherein the step portion and the stopper together restrict radial movement of the slider within a distance defined by a width of the flange.

15. The pump according to claim 11, wherein the arcuate wall portion comprises:

a spherical projection extending from an inner surface thereof, and adapted to abut with the tapering portion of the first connector; and at least one groove defined at an outer surface thereof.

16. The pump according to claim 15, wherein the connecting assembly further comprises at least one seal disposed in the at least one groove of the arcuate wall portion to engage with the inner surface of the neck of the container.

17. The pump according to claim 16, wherein the at least one seal is an O-ring adapted to bias the plurality of sliders towards the tapering portion of the first connector.

18. The pump according to claim 7, wherein the first connector comprises at least one hand grip.

* * * * *